US010770281B2

(12) United States Patent
Hazama

(10) Patent No.: US 10,770,281 B2
(45) Date of Patent: Sep. 8, 2020

(54) ION TRAP DEVICE

(71) Applicant: Shimadzu Corporation, Kyoto (JP)

(72) Inventor: Makoto Hazama, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 16/471,727

(22) PCT Filed: Mar. 1, 2018

(86) PCT No.: PCT/JP2018/007712
§ 371 (c)(1),
(2) Date: Jun. 20, 2019

(87) PCT Pub. No.: WO2018/163950
PCT Pub. Date: Sep. 13, 2018

(65) Prior Publication Data

US 2020/0090921 A1 Mar. 19, 2020

(30) Foreign Application Priority Data

Mar. 7, 2017 (JP) ..... 2017-042631

(51) Int. Cl.
*H01J 49/42* (2006.01)
*H01J 49/04* (2006.01)

(52) U.S. Cl.
CPC ..... *H01J 49/427* (2013.01); *H01J 49/0486* (2013.01); *H01J 49/424* (2013.01); *H01J 49/4295* (2013.01)

(58) Field of Classification Search
USPC ..... 250/292, 291, 290
See application file for complete search history.

(56) References Cited

U.S. PATENT DOCUMENTS

2007/0071646 A1* 3/2007 Schoen ..... H01J 49/02 422/68.1
2008/0035841 A1 2/2008 Ding
(Continued)

FOREIGN PATENT DOCUMENTS

JP 2007-527002 A 9/2007
JP 2008-282594 A 11/2008
(Continued)

OTHER PUBLICATIONS

Furuhashi et al., "Dejitaru Ion Torappu Shitsuryou Bunseki Souchi No Kaihatsu (Development of Digital Ion Trap Mass Spectrometer)", Shimadzu Hyouron (Shimadzu Review), Shimadzu Hyouron Henshuubu, Mar. 31, 2006, vol. 62, Nos. 3•4, pp. 141-151; 11 pgs.
(Continued)

*Primary Examiner* — Kiet T Nguyen
(74) *Attorney, Agent, or Firm* — Maier & Maier, PLLC

(57) ABSTRACT

An ion trap includes: an ion trap including a plurality of electrodes; a rectangular voltage generator including a voltage source for generating a direct voltage and a switching section, the rectangular voltage generator configured to operate the switching section to generate a rectangular voltage by switching the direct voltage generated by the voltage source and to apply the rectangular voltage to at least one of the plurality of electrodes; and a switching section temperature controller configured to control a temperature of the switching section so as to maintain the temperature of the switching section at a target temperature which is higher than a highest reaching temperature of the switching section.

5 Claims, 4 Drawing Sheets

(56) References Cited

U.S. PATENT DOCUMENTS

| | | | | |
|---|---|---|---|---|
| 2008/0277580 | A1 | 11/2008 | Takeshita et al. | |
| 2010/0065740 | A1 | 3/2010 | Iwamoto et al. | |
| 2019/0157058 | A1* | 5/2019 | Mizutani ..... | H01J 49/022 |

FOREIGN PATENT DOCUMENTS

| | | | |
|---|---|---|---|
| JP | 2011-023167 | A | 2/2011 |
| WO | 2008/129850 | A1 | 10/2008 |

OTHER PUBLICATIONS

International Search Report and Written Opinion dated Apr. 17, 2018 of corresponding application No. PCT/JP2018/007712; 7 pgs.

* cited by examiner

ION TRAP DEVICE

FIELD

The present disclosure relates to an ion trap device for capturing ions and selecting ions by the effect of a radio-frequency electric field. More specifically, it relates to an ion trap device which uses a rectangular voltage as a voltage for generating the radio-frequency electric field.

BACKGROUND

An ion trap is used in a mass spectrometer in order to capture and confine ions by the effect of a radio-frequency electric field, select an ion having a specific mass-to-charge ratio (m/z) well as fragment the ion selected in such a manner. A typical ion trap is a three-dimensional quadrupole ion trap formed by a single ring electrode having an inner surface in the form of a hyperboloid of one sheet as well as a pair of end-cap electrodes having an inner surface in the form of a hyperboloid of two sheets facing each other across the ring electrode. Another commonly known type is a linear ion trap formed by four rod electrodes arranged parallel to each other. In the present description, the "three-dimensional quadrupole type" is used as an example of the ion trap for convenience of explanation.

In a conventional and common type of ion trap, a sinusoidal radio-frequency voltage is normally applied to the ring electrode to create a radio-frequency ion-capturing electric field within the space surrounded by the ring electrode and the end-cap electrodes so as to confine ions by the radio-frequency electric field while oscillating the ions. Meanwhile, in recent years, a type of ion trap which confines ions by applying a rectangular voltage to the ring electrode in place of the sinusoidal radio-frequency voltage has been developed (for example, see Patent Literature 1, Patent Literature 2 or Non-Patent Literature 1). This type of ion trap is called the "digital ion trap (DIT)" since it normally uses a rectangular voltage having the binary voltage levels of "High" and "Low".

In the conventional analogue-driven type of ion trap, an LC resonator is used to generate the sinusoidal radio-frequency voltage. The mass-to-charge-ratio range of the ions that can be captured is controlled by regulating the amplitude of the sinusoidal radio-frequency voltage. On the other hand, in the case of the digital ion trap, the rectangular high-frequency voltage is generated by the high-speed switching of two direct voltages. The mass-to-charge-ratio range of the ions that can be captured is controlled by changing the frequency of the rectangular voltage while constantly maintaining the amplitude of the voltage. This allows the amplitude of the high voltage applied to the ring electrode to be lower than in the case of the analogue-driven type, so that the circuit for generating the radio-frequency voltage can be created at a lower cost. Another advantage is that the generation of unwanted electric discharge between the electrodes can be avoided.

The rectangular voltage applied to the ring electrode in the previously described digital ion trap is normally switched between ±several hundred volts or ±several kilovolts. Its frequency is varied within a considerable range, from several ten kHz to several MHz. In order to generate such a rectangular voltage, a high-speed semiconductor switching element, such as a power MOSFET, is used in the radio-frequency voltage generation circuit to switch between a positive voltage and a negative voltage (see Patent Literature 2 or Non-Patent literature 1). Such a semiconductor switching element (which is hereinafter simply called the "switching element") generates a certain amount of heat during the switching operation. Therefore, the temperature of the switching element used in a digital ion trap will be considerably high. This temperature increases with the frequency of the switching operation.

In a mass spectrometer using the previously described type of ion trap, it has generally been the case that a rectangular voltage having a low frequency (e.g. equal to or lower than 20 kHz) which significantly deviates from the normal frequency range used for capturing ions is applied to the ring electrode during a standby state in which no analysis is being undertaken, in order to completely remove unwanted ions remaining within the ion trap. When an analysis is initiated from such a standby state, the frequency of the rectangular voltage applied to the ring electrode is increased, so that the temperature of the switching element becomes higher than in the standby state. Such a change in the temperature causes a change in the on-state resistance or other electric characteristics of the switching element, which in turn causes a slight yet certain change in the amplitude of the rectangular voltage. Therefore, after the frequency of the rectangular voltage is switched from the low frequency to the high frequency for an analysis, the amplitude of the rectangular voltage will gradually change (i.e. drift) with the increasing temperature of the switching element until this temperature is stabilized.

An analysis by a mass spectrometer is normally performed as follows: A process which includes the successive steps of generating ions, introducing the ions into an ion trap, as well as ejecting and detecting the ions by a mass scan is repeatedly performed for one sample. A mass profile is obtained by each mass scan, and the obtained mass profiles are accumulated in a computer to obtain a mass spectrum with a high signal-to-noise ratio (for example, see Patent Literature 3). The timing at which an ion having a certain mass-to-charge ratio is ejected from the ion trap in the mass scan depends on the frequency and amplitude of the rectangular voltage. Therefore, if the amplitude of the rectangular voltage gradually changes due to the temperature change as described earlier, the point in time of the ejection of the ion having the same mass-to-charge ratio gradually shifts with the repetition of the mass scan. Accumulating mass profiles obtained with such a shift will result in a deterioration of the mass resolution of the mass spectrum.

The present inventor has proposed an ion trap device having the function of reducing the drift of the ion-ejection time in the mass scan, as disclosed in Patent Literature 4. In the ion trap device described in that document, after an analysis of one sample has been completed, the reaching temperature of the switching element in the next analysis is predicted, and the switching element is turned on and off at a frequency required for maintaining that temperature during the standby period until the analysis for the next sample is initiated. This operation reduces the amount of change in the temperature of the switching element at the transition from the standby state to the next analysis, and thereby decreases the drift of the ion-ejection time due to the temperature change (it should be noted that the ions remaining within the ion trap are completely removed by lowering the frequency for a short period of time immediately before the execution of the next analysis).

Patent Literature: 1: IP 2007-527002 A
Patent Literature 2: JP 2008-282594 A
Patent Literature 3: WO 2008/129850 A
Patent Literature 4: JP 2011-023167 A Non-Patent Literature 1: Furuhashi, Takeshita, Ogawa, Iwamoto, Ding, Giles, and Smirnov, "Dejitaru Ion Torappu Shitsuryou Bunseki Souchi No Kaihatsu (Development of Digital Ion Trap Mass Spectrometer)", *Shimadzu Hyouron* (*Shimadzu Review*), Shimadzu Hyouron Henshuubu, Mar. 31, 2006, Vol. 62, Nos. 3·4, pp. 141-151

SUMMARY

However, the frequency of the rectangular voltage to be applied from the radio-frequency voltage generation circuit to the electrodes constituting the ion trap during the execution of the analysis changes depending on the analysis conditions (e.g. the mass-to-charge-ratio range to be covered by the measurement, or the mass-resolving power). This means that the reaching temperature of the switching element during the repetition of the mass scan under those analysis conditions also changes depending on the analysis conditions.

For example, consider the case where there are two measurement modes, i.e. mode "A" in which a mass range of m/z 500 to m/z 3000 is repeatedly scanned, and mode "B" in which a mass range of m/z 1000 to m/z 5000 is repeatedly scanned. Due to the difference in the mass-to-charge-ratio range to be covered by the measurement, the two modes have different frequency ranges for the switching operation in the mass scan. Consequently, the reaching temperature of the switching element during the execution of the analysis will be different (for example, 80 degrees Celsius in measurement mode A, and 120 degrees Celsius in measurement mode B). As noted earlier, a change in the temperature of the switching element causes a change in the amplitude of the obtained rectangular voltage, and furthermore, the timing at which an ion having a certain mass-to-charge ratio is ejected from the ion trap during the mass scan depends on not only the frequency of the rectangular voltage but also its amplitude. Consequently, the measurement modes A and B will have a slight difference in the frequency of the switching operation required for ejecting an ion of the same mass-to-charge ratio (e.g. m/z 2000). Therefore, for a high-precision mass measurement, it is necessary to perform a measurement of a standard sample having a known mass-to-charge ratio in each measurement mode and correct the mass-to-charge ratio axis of the mass spectra for each measurement mode (this operation is called the "mass calibration"). Such a task is cumbersome and places a considerable workload on the user.

The present invention has been developed to solve the previously described problem. Its objective is to provide an ion trap device which can perform a mass spectrometric analysis with a high level of accuracy by reducing not only the influence of the drift of the ion-ejection time but also the influence of a change in the analysis conditions.

The ion trap device according to the present invention developed for solving the previously described problem includes:

a) an ion trap including a plurality of electrodes;

b) a rectangular voltage generator including a voltage source for generating a direct voltage and a switching section, the rectangular voltage generator configured to operate the switching section to generate a rectangular voltage by switching the direct voltage generated by the voltage source, and to apply the rectangular voltage to at least one of the plurality of electrodes; and c) a switching section temperature controller configured to control the temperature of the switching section so as to maintain the temperature of the switching section at a target temperature which is higher than the highest reaching temperature of the switching section during an operation of the ion trap and lower than the highest permissible temperature for the operation of the switching section.

The "highest reaching temperature of the switching section during an operation of the ion trap" means the highest value among the temperatures which the switching section will reach (and stabilize at) if mass spectrometric analyses under various analysis conditions that can be executed using the ion trap device are performed without controlling the temperature of the switching section. For example, it can be previously determined by measurements.

In the ion trap device according to the present invention, the switching section for generating the rectangular voltage can be maintained at an almost constant temperature. Therefore, no drift of the ion-ejection time occurs at the transition from a standby state to an analyzing state, and consequently, a mass spectrum with a high level of mass resolution can be obtained even in the case where a mass scan is repeatedly performed for one sample and a mass spectrum is created by accumulating mass profiles individually obtained through the mass scans. Furthermore, the ion trap device according to the present invention prevents the reaching temperature of the switching section from changing depending on the analysis conditions, Therefore, a high level of mass accuracy can be achieved without requiring mass calibration to be performed for each measurement mode.

In one mode of the ion trap device according to the present invention, the switching section includes a semiconductor switching element, and the switching section temperature controller includes:

d) a heatsink thermally connected to the semiconductor switching element;

e) a heater configured to heat the heatsink;

f) a temperature sensor configured to measure the temperature of the heatsink; and g) a controller configured to control the heater so that the temperature measured with the temperature sensor becomes closer to the target temperature.

The state in which the heatsink is "thermally connected to the semiconductor switching element" includes not only the state in which the heatsink is in direct contact with the semiconductor switching element but also the state in which the heatsink is connected to the semiconductor switching element via a highly heat-conductive member, adhesive, grease or similar substance.

In an ion trap device, the rectangular voltage generator (radio-frequency voltage generation circuit) normally includes two voltage sources which respectively generate direct voltages with different values, e.g. a first voltage source which generates a direct voltage of +1 kV and a second voltage source generates a direct voltage of −1 kV. A first switching section for turning on and off the output voltage from the first voltage source and a second switching section for turning on and off the output voltage from the second voltage source are alternately turned on and off to generate a rectangular voltage. Meanwhile, Si-MOSFET, which is a type of switching element commonly used in ion trap devices, has a low withstand voltage of approximately 400 V. Therefore, it has been necessary to construct each of those switching sections from a plurality of switching elements (e.g. three) connected in series in order to distribute the voltage. In an ion trap having such a configuration, if the aforementioned temperature control using the heatsink, heater and temperature sensor were to be performed for each switching element included in those switching sections, the number of components would be extremely large, and the production cost would be increased.

Accordingly, in a preferable mode of the ion trap device according to the present invention, the rectangular voltage generator includes:

h) a first voltage source configured to generate a direct voltage;

i) a second voltage source configured to generate a direct voltage different from the direct voltage generated by the first voltage source;

j) a first switching section configured to turn on and off an output of the direct voltage from the first voltage source; and k) a second switching section configured to turn on and off an output of the direct voltage from the second voltage source, and the rectangular voltage generator is configured to generate the rectangular voltage by alternately turning on and off the first switching section and the second switching section, where the first switching section and the second switching section are each formed by a single semiconductor switching element made of a silicon carbide semiconductor.

A switching element made of a silicon carbide (SiC) semiconductor has a higher level of withstand voltage than those made of a normal silicon (Si) semiconductor (for example, SiC-MOSFET has a withstand voltage of approximately 1200 V). Therefore, it is unnecessary to serially connect a plurality of semiconductor switching elements in order to distribute the voltage as in the common type of ion trap device mentioned earlier. Each switching section can be constructed with a single semiconductor switching element, Consequently, the number of heatsinks, heaters and temperature sensors required for the temperature control will be decreased, so that the device can be realized at a low cost.

Conventional heatsinks are typically made of aluminum, iron, copper or other kinds of highly heat-conductive metal. Those kinds of metal are also good conductors of electricity. Attaching such a conductor to a switching element which operates at a high frequency causes the problem that the heatsink acts as an antenna and radiates radio-frequency noise, as well as the problem that the heatsink acts as a passage of electric current between the switching elements if two or more switching elements having different voltages to turn on and off are attached to the heatsink (although each semiconductor switching element is packaged in an insulator, electric current flows if the switching operation is performed at MHz levels).

Accordingly, in a preferable mode of the ion trap device according to the present invention, a heatsink made of a ceramic material is used as the heatsink.

Since ceramic materials have high levels of electric insulation properties, the radiation of the radio-frequency noise mentioned earlier can be prevented by using a heatsink made of a ceramic material as the heatsink to be connected to the switching element. A preferable example of the heatsink made of a ceramic material is a heatsink made of aluminum nitride (AlN), which is excellent in both thermal conductivity and electric insulation properties.

The use of a ceramic heatsink having excellent electric insulation properties also prevents the passage of electric current between the switching elements even if a single heatsink is used for the temperature control of a plurality of switching elements having different voltages to turn on and off.

In summary, the ion trap device according to the present invention may include a single heatsink thermally connected to a plurality of semiconductor switching elements.

Such a configuration further reduces the number of heatsinks, heaters and temperature sensors to be used for the temperature control of the switching elements, so that the device can be produced at an even lower cost.

As described to this point, the ion trap device according to the present invention can maintain the switching section at a constant temperature. This reduces the influence of the drift of the ion-ejection time at a transition from a standby state to an analyzing state as well as suppresses the change in the amplitude of the rectangular voltage due to a change in the analysis mode during an analyzing process, so that a high-accuracy mass measurement is possible.

DETAIL DESCRIPTION

Figure 1:
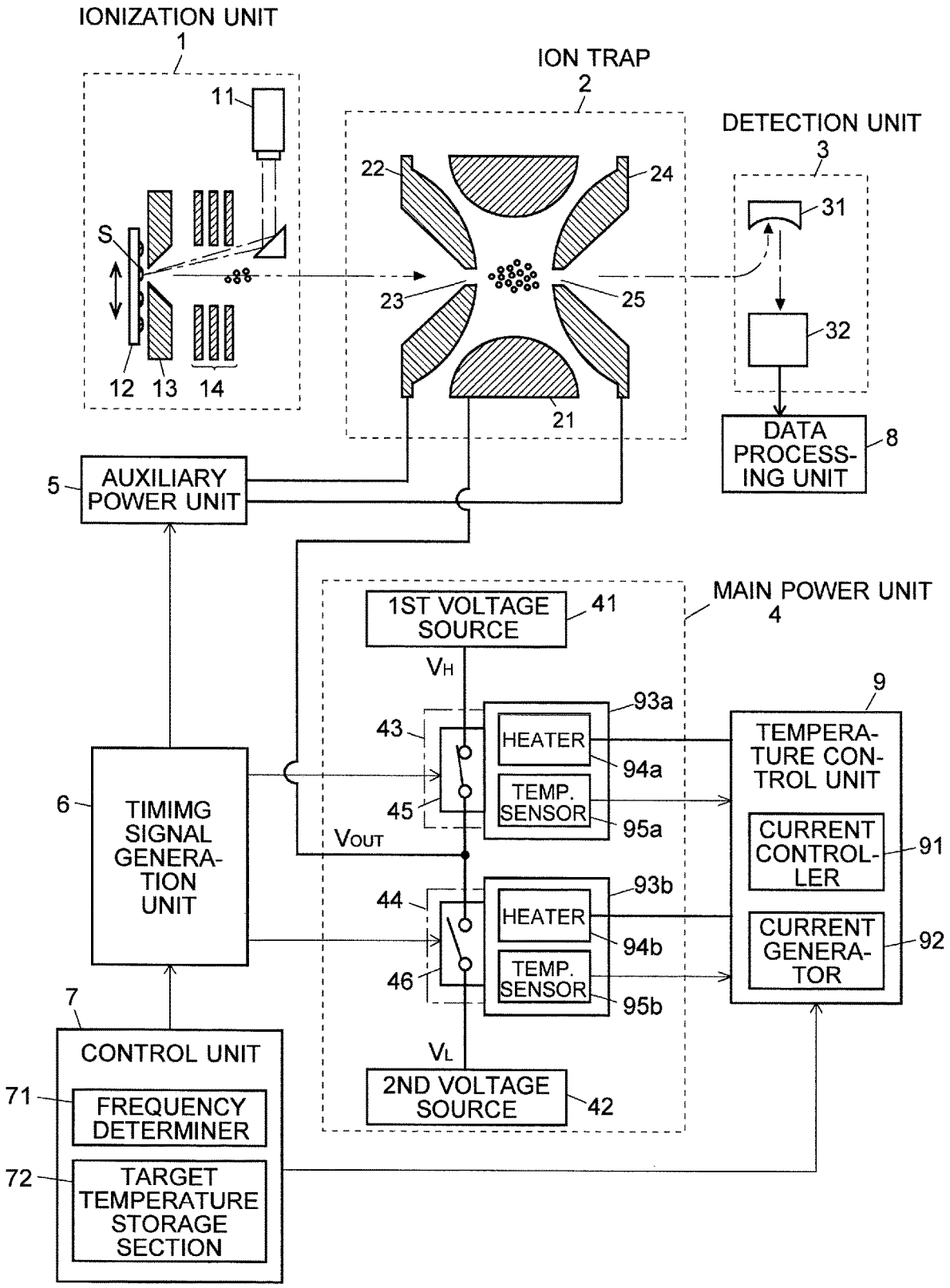
FIG. 1 is configuration diagram of the main components of an ion trap mass spectrometer including an ion trap device according to one embodiment of the present invention.

One embodiment of the ion trap mass spectrometer including am ion trap device according to the present invention is hereinafter described with reference to the attached drawings. FIG. 1 is a configuration diagram of the main components of the ion trap mass spectrometer according to the present embodiment.

The ion trap mass spectrometer according to the present embodiment includes an ionization unit 1, ion trap 2, detection unit 3, main power unit 4, auxiliary power unit 5, timing signal generation unit 6, control unit 7, data processing unit 8 and temperature control unit 9.

The ionization unit 1 employs matrix assisted laser desorption ionization (MALDI), This unit includes a laser-beam generator 11 for generating a pulsed laser beam, a sample plate 12 to which a sample S containing a target sample component is attached, an extraction electrode 13 for extracting ions released from the sample irradiated with the laser light, an ion lens 14 for guiding the extracted ions, as well as other elements. Needless to say, the ionization unit 1 may employ a type of laser ionization method which is different from the MALDI, or an ionization method which does not use laser light.

The ion trap 2 is a three-dimensional quadrupole type of ion trap including an annular ring electrode 21 as well as an entrance end-cap electrode 22 and an exit end-cap electrode 24 facing each other across the ring electrode 21. The space surrounded by these three electrodes 21, 22 and 24 forms an ion-capturing area. The entrance end-cap electrode 22 has an ion injection hole 23 bored in its central portion. Ions ejected from the ionization unit 1 are introduced through this ion injection hole 23 into the ion trap 2. The exit end-cap electrode 22 has an ion ejection hole 25 bored in its central portion. Ions ejected from the ion trap 2 through this ion ejection hole 25 arrive at and are detected by the detection unit 3.

The detection unit 3 includes a conversion dynode 31 for converting ions into electrons as well as a secondary electron multiplier tube 32 for multiplying and detecting electrons coming from the conversion dynode 31. This unit sends a detection signal corresponding to the amount of incident ions to the data processing unit 8.

The main power unit 4 (which corresponds to the rectangular voltage generator in the present invention) for driving the ion trap 2 includes a first voltage source 41 for generating a first voltage $V_H$, a second voltage source 42 for generating a second voltage $V_L$ ($V_L<V_H$), as well as a first switching section 42 and a second switching section 44 which are connected in series between the output terminal of the first voltage source 41 and that of the second voltage source 42. A rectangular output voltage $V_{OUT}$ is extracted from the line which serially connects the two switching sections 42 and 44, and is applied to the ring electrode 21. The auxiliary power unit 5 applies a direct voltage or rectangular voltage to each of the end-cap electrodes 22 and 24.

The first voltage $V_H$ generated from the first voltage source 41 is approximately +1 kV, while the second voltage $V_L$ generated from the second voltage source 42 is approximately −1 kV. Accordingly, the switching sections 43 and 44 connected between these voltage sources 41 and 42 must have a high level of withstand voltage. Accordingly, in the ion trap device according to the present embodiment, the first switching section 43 and the second switching section 44 are each formed by a single semiconductor switching element made of silicon carbide (SiC), or more specifically, a SiC-MOSFET. Since SiC-MOSFETs have a high withstand voltage of 1200 V, the switching sections can correctly function even if they have only one SiC-MOSFET at the output end of the first voltage source 41 and only one SiC-MOSFET at the output end of the second voltage source 42. Such a configuration in which the first switching section 43 and the second switching section 44 are each made of a single semiconductor switching element (those elements are hereinafter called the "first switching element 45" and the "second switching element 46") reduces the number of heatsinks, heaters and temperature sensors (which will be described later).

Figure 2:
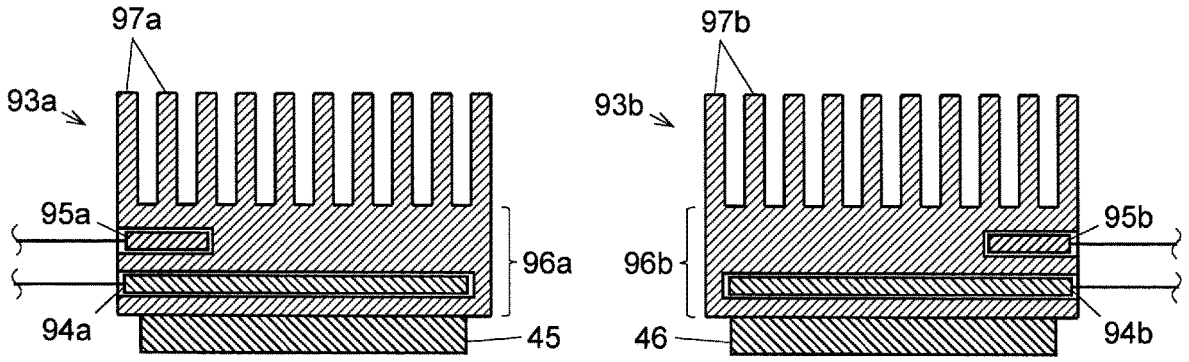
FIG. 2 is a sectional view showing a schematic configuration of the heatsinks, heaters, temperature sensors and switching elements in the same embodiment.

The main power unit 4 further includes a first heatsink 93*a* and a second heatsink 93*b* as the characteristic components of the present invention. Both heatsinks 93*a* and 93*b* are made of aluminum nitride, which is a highly heat-conductive ceramic material. The first heatsink 93*a* is attached to the first switching element 45, while the second heatsink 93*b* is attached to the second switching element 46. FIG. 2 shows a cross sectional structure of these heatsinks. Each of the heatsinks 93*a* and 93*b* has a rectangular parallelpiped base portion 96*a* or 96*h* with a plurality of plate-shaped fins 97*a* or 97*b* standing on its upper surface. The base portion 96*a* or 96*b* has cavities extending from its side surface inwards, with a sheet heater 94*a* or 94*b* and a temperature sensor 95*a* or 95*b* inserted into those cavities, respectively. Although the heater 94*a* or 94*b* in FIG. 2 is located above the temperature sensor 95*a* or 95*b*, their positional relationship is not limited to this one. For example, the temperature sensor 95*a* or 95*b* may be located at a lateral side of the heater 94*a* or 94*b*. The heater 94*a* or 94*b* may be integrally formed with the heatsink 93*a* or 93*b* by sintering the aluminum nitride after embedding the heater 94*a* or 94*b* in the base portion 96*a* or 96*b* in the production process of the heatsink 93*a* or 93*b*. The temperature sensors 95*a* and 95*b* as well as the heaters 94*a* and 94*b* are individually connected to the temperature control unit 9.

The temperature control unit 9 includes a current generator 92 for supplying a heating current to each heater 94*a* or 94*b*, and a current controller 91 consisting of a microcomputer and other components for regulating the heating current based on the detection signal from each temperature sensor 95*a* or 95*b*.

The control unit 7 is composed of a personal computer and other related devices. Its functions are achieved by executing a control-and-processing program previously installed on the personal computer. The control unit 7 includes a frequency determiner 71 and a target temperature storage section 72 as its characteristic functional blocks. The target temperature storage section 72 is configured to store a target temperature T used for the temperature control of the first switching section 43 and the second switching section 44. The frequency determiner 71 determines the frequency of the drive pulses to be fed to the first switching section 43 and the second switching section 44 based on the analysis conditions which have been set by a user.

The timing signal generation unit 6 is a hardware-based logic circuit. This circuit generates drive pulses to be used for controlling the on/off operation of the first switching section 43 and the second switching section 44 based on the frequency determined by the frequency determiner 71, and applies the drive pulses to the main power unit 4. The same circuit also applies auxiliary pulses to the auxiliary power unit 5. For example, these auxiliary pulses are generated by dividing the drive pulses applied to one of the two switching sections by an appropriate division ratio. The first switching section 43 and the second switching section 44 are driven so that they will be alternately turned on (under the condition that they should not be simultaneously in the ON state at any moment). Turning on the first switching section 43 leads to the output of the first voltage $V_H$, while turning on the second switching section 44 leads to the output of the second voltage $V_L$. Accordingly, the output voltage $V_{OUT}$ will ideally be a rectangular voltage with the high level of $V_H$ and the low level of $V_L$. When the frequency of the pulses for driving the switching elements 45 and 46 is changed by the timing signal generation unit 6, the frequency of the rectangular voltage will change while its amplitude (voltage level) is maintained.

A mass spectrometric analysis of ions in the ion trap mass spectrometer according to the present embodiment is performed as follows: Under the control of the controller 7, the laser-beam generator 11 emits a laser beam for a short period of time. The laser beam hits the sample S. Due to the irradiation with the laser beam, the matrix in the sample S is rapidly heated and turns into vapor carrying the target component. The target component is ionized through this process. The generated ions are converged by an electrostatic field formed by the ion lens 14 and introduced through the ion injection hole 23 into the ion trap 2. Meanwhile, drive pulses with a predetermined frequency are supplied from the timing signal generation unit 6 to the switching elements 45 and 46. A rectangular voltage with a frequency corresponding to the drive pulses is generated in the main power unit 4 and applied to the ring electrode 21. A radio-frequency electric field is thereby created within the ion trap 2, and ions which fall within a predetermined mass-to-charge-ratio range are captured in a stable manner within the ion trap 2 due to the effect of the radio-frequency electric field.

Then, the ions are cooled by coming in contact with a cooling gas which has been introduced into the ion trap 2 before the introduction of the ions. Subsequently, the frequency of the drive pulses supplied from the timing signal generation unit 6 to the switching elements 45 and 46 is continuously changed. With this operation, the frequency of the rectangular voltage supplied from the main power unit 4 to the ring electrode 21 continuously changes, whereby the ions are sequentially ejected from the ion ejection hole 25 in order of mass-to-charge ratio (this operation is hereinafter called the "mass scan"). The ejected ions are sequentially detected in the detection unit 3. The data processing unit 8 obtains one mass profile for each mass scan.

The amount of ions generated by a single pulse of laser in the previously described manner is rather small. Therefore, the operation including the steps of irradiating the sample S with the laser light, capturing ions within the ion trap 2, performing the mass scan, and detecting the ions in the ion detection unit 3 is further repeated a predetermined number of times (e.g. 10 times; such a repetition is hereinafter called the "repetitive analysis"). The data processing unit 8 creates a mass spectrum by accumulating a predetermined number of mass profiles. After a series of analyses for one sample has been completed, the ion trap 2 is switched to and maintained in the standby state until the analysis of the next sample.

Hereinafter described is a temperature control operation for the switching elements 45 and 46, which is a characteristic operation of the ion trap mass spectrometer according to the present embodiment.

In the ion trap mass spectrometer according to the present embodiment, the temperature of the switching elements 45 and 46 is controlled by the previously described components including the heatsinks 93*a* and 93*b*, heaters 94*a* and 94*b*, temperature sensors 95*a* and 95*b* as well as temperature control unit 9. These components correspond to the switching section temperature controller.

The method of setting the target temperature T for the temperature control is initially described. The frequency of the rectangular voltage applied to the ring electrode 21 is continuously changed during the mass scan. The temperature which will be ultimately reached by the switching sections 43 and 44 in a repetitive analysis is roughly determined by the analysis conditions, since the change in the frequency is sufficiently faster than the change in the temperature of the switching elements 45 and 46 while the repetitive analysis for one sample is performed under the same analysis condition. Accordingly, for example, by the manufacturer of the device, an analysis condition under which the reaching temperature of the switching sections 43 and 44 will be the highest is identified among the various analysis conditions which are implementable in the mass spectrometer according to the present embodiment. Then, a specific temperature between the reaching temperature of the switching sections 43 and 44 under that analysis condition and the highest permissible temperature for the operation of the switching sections 43 and 44 is designated as the target temperature T and stored in the target temperature storage section 72. Alternatively, or additionally, the device may be configured to allow users to set the target temperature T. In that case, the highest reaching temperature and the highest permissible temperature for the operation should be stored in a storage section (not shown) in the control unit 7, Before the execution of an analysis, or at any other appropriate timing, the control unit 7 prompts the user to enter the target temperature T within a temperature range which is higher than the highest reaching temperature and lower than the highest permissible temperature for the operation. The device may also be configured as follows: After the analysis conditions for mass spectrometric analyses which are going to be performed have been set by the user, the control unit 7 identifies, before the execution of the analyses, an analysis condition under which the reaching temperature of the switching sections 43 and 44 will be the highest among those analysis conditions. Then, the control unit 7 prompts the user to enter the target temperature T within a temperature range which is higher than the reaching temperature under that analysis condition and lower than the highest permissible temperature for the operation of the switching elements, or automatically determines the target temperature T within that temperature range.

Upon receiving a command to initiate an analysis from the user, the control unit 7 sends the target temperature T stored in the target temperature storage section 72 to the temperature control unit 9. The current controller 91 in the temperature control unit 9 compares the target temperature T with the temperatures detected with the temperature sensors 95*a* and 95*b*, as well as regulates the values of the heating currents supplied to the heaters 94*a* and 94*b* to decrease the difference between the target and detected temperatures. The current generator 92 supplies the heating currents to the heaters 94*a* and 94*b* under the control of the current controller 91. When the temperatures detected with the temperature sensors 95*a* and 956 have reached the target temperature T, the device performs a series of mass spectrometric analyses (repetitive analysis) for the first sample (which is hereinafter called "Sample S1") by the previously described procedure while continuing the temperature control by the temperature control unit 9.

After the series of mass spectrometric analyses have been completed, the device shifts into the standby state while continuing the temperature control by the temperature control unit 9. At this transition, the frequency of the drive pulses fed to the switching elements 45 and 46 is decreased from the level used in the analysis to a lower frequency (e.g. 20 kHz or lower) to remove the ions remaining within the ion trap 2. Then, the frequency of the drive pulses is once more increased to a high level to perform a series of mass spectrometric analysis for the next sample (which is hereinafter called "Sample S2"). The temperature control by the temperature control unit 9 is continued throughout such a process. After that, the standby state and the series of analyses are alternated. The temperature control of the switching elements 45 and 46 is discontinued when all previously set analyses have been completed.

As described to this point, in the mass spectrometer including the ion trap device according to the present embodiment, the temperature of the switching elements 45 and 46 is maintained at the target temperature T during the analysis of Sample S1, during the standby period, as well as during the analysis of Sample S2. Since there is no temperature change of the switching elements 45 and 46 at the transition from the standby state to the analysis of Sample S2, a mass profile with no drift of the ion-ejection time can be obtained. No difference in the temperature of the switching elements 45 and 46 occurs between the analysis of Sample S1 and that of Sample S2 even if the two samples are analyzed under different conditions. Therefore, a high-accuracy mass spectrometric analysis can be achieved without requiring mass calibration to be performed for each different analysis condition as in the prior art.

Figure 3:
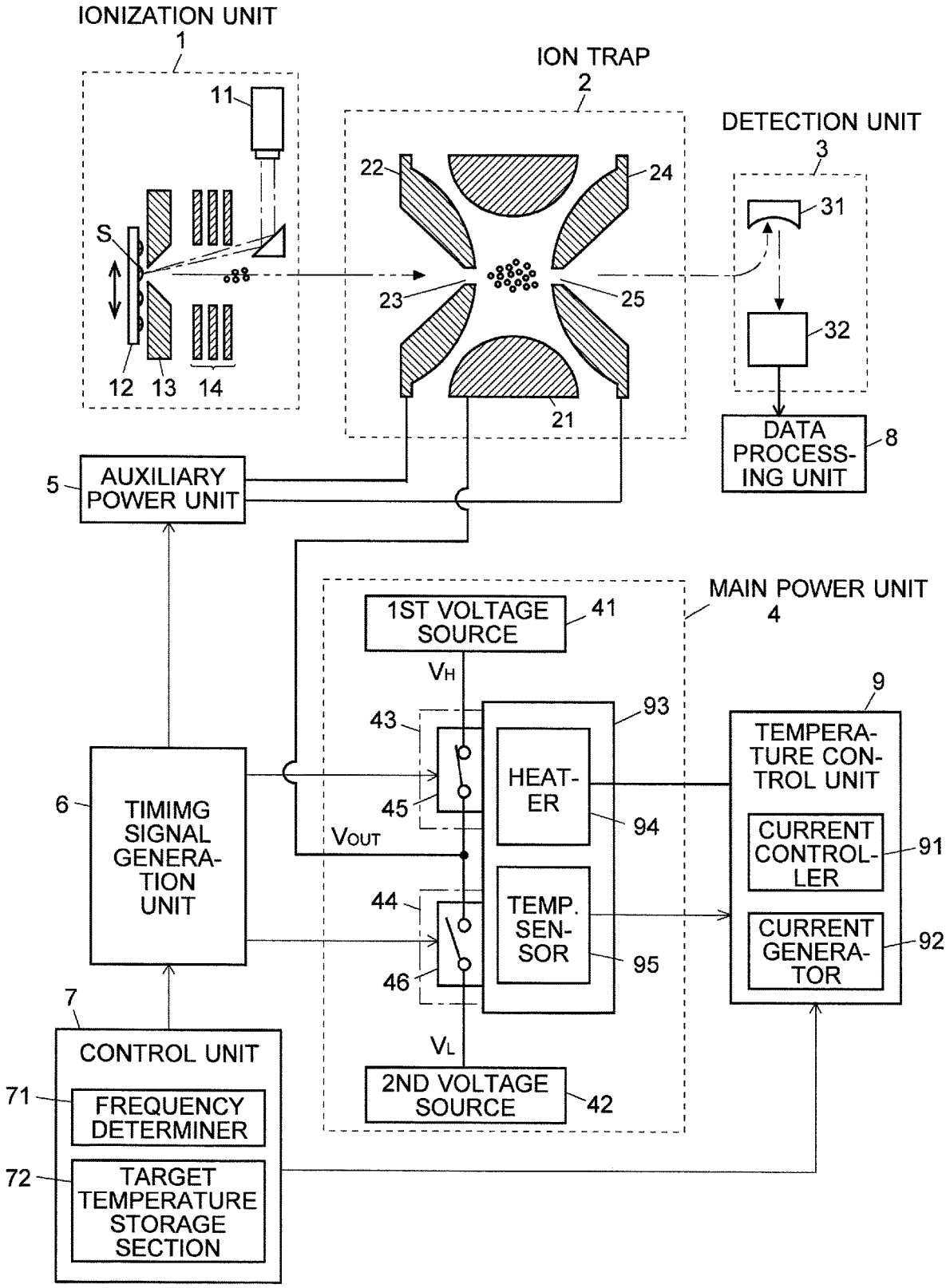
FIG. 3 is configuration diagram of the main components of an ion trap mass spectrometer including an ion trap device according to another embodiment of the present invention.
Figure 4:
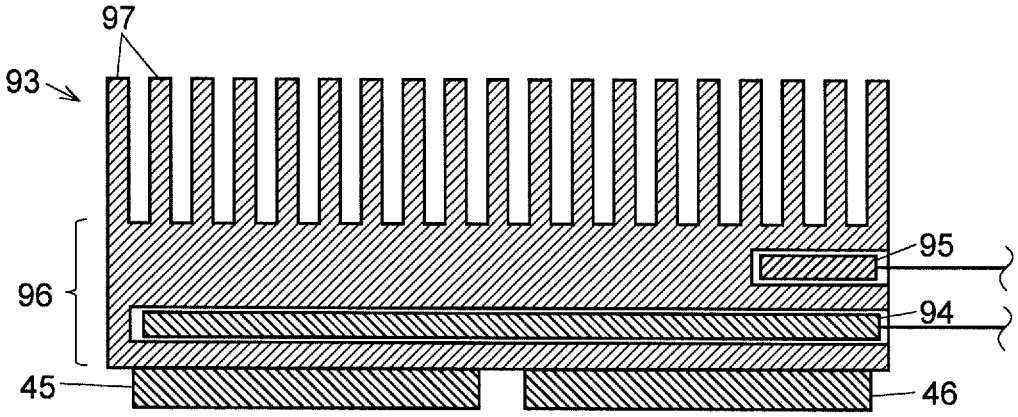
FIG. 4 is a sectional view showing a schematic configuration of the heatsink, heater, temperature sensor and switching elements in the same embodiment.

A mode for carrying out the present invention has been described so far with reference to the embodiment. The present invention is not limited to the previous embodiment and may be appropriately changed within the spirit of the present invention. For example, as shown in FIGS. 3 and 4, a single heatsink 93 may be provided for the first switching section 43 and the second switching section 44. In this case, the bottom surface of the single heatsink 93 is attached to the switching element 45 of the first switching section 43 and the switching element 46 of the second switching section 44. The temperature control of the first switching section 43 and the second switching section 44 is performed by means of the heater 94 and the temperature sensor 95 inside the heatsink 93 as well as the temperature control unit 9 connected to those elements. Such a configuration decreases the number of heatsinks, heaters and temperature sensors required for the temperature control, so that the device can be produced at an even lower cost. The heatsink 93 in this case may also be preferably made of aluminum nitride having a high level of electric insulation properties. This reduces the radiation of the radio-frequency noise as well as prevents the heatsink 93 from acting as a passage of electric current between the switching elements 45 and 46.

Although the device shown in the previous embodiment is a three-dimensional quadrupole type of ion trap, the present invention is also applicable to a linear ion trap if it is a digitally driven type of ion trap.

The invention claimed is:

1. An ion trap device, comprising:

a) an ion trap including a plurality of electrodes;

b) a rectangular voltage generator including a voltage source for generating a direct voltage and a switching section, the rectangular voltage generator configured to operate the switching section to generate a rectangular voltage by switching the direct voltage generated by the voltage source, and to apply the rectangular voltage to at least one of the plurality of electrodes; and c) a switching section temperature controller configured to control a temperature of the switching section so as to maintain the temperature of the switching section at a target temperature which is higher than a highest reaching temperature of the switching section during an operation of the ion trap and lower than a highest permissible temperature for an operation of the switching section.

2. The ion trap device according to claim 1, wherein the switching section includes a semiconductor switching element; and the switching section temperature controller further comprises:

d) a heatsink thermally connected to the semiconductor switching element;

e) a heater configured to heat the heatsink;

f) a temperature sensor configured to measure a temperature of the heatsink; and g) a controller configured to control the heater so that the temperature measured with the temperature sensor becomes closer to the target temperature.

3. The ion trap device according to claim 2, wherein the heatsink is made of a ceramic material.

4. The ion trap device according to claim 2, wherein the switching section includes a plurality of the semiconductor switching elements, and the heatsink is thermally connected to at least two of the semiconductor switching elements.

5. The ion trap device according to claim 1, wherein the rectangular voltage generator further comprises:

h) a first voltage source configured to generate a direct voltage;

i) a second voltage source configured to generate a direct voltage different from the direct voltage generated by the first voltage source;

j) a first switching section configured to turn on and off an output of the direct voltage from the first voltage source; and k) a second switching section configured to turn on and off an output of the direct voltage from the second voltage source, and the rectangular voltage generator is configured to generate the rectangular voltage by alternately turning on and off the first switching section and the second switching section, where the first switching section and the second switching section are each formed by a single semiconductor switching element made of a silicon carbide semiconductor.

* * * * *